United States Patent [19]

Zegota

[11] 4,401,704

[45] Aug. 30, 1983

[54] NON-STICK LATEX FOAM FLUOROCARBON CARPET BACKING

[75] Inventor: Michael Zegota, Brantford, Canada

[73] Assignee: Harding Carpets Limited, Rexdale, Canada

[21] Appl. No.: 390,414

[22] Filed: Jun. 21, 1982

[30] Foreign Application Priority Data

Mar. 24, 1982 [CA] Canada ..... 399238

[51] Int. Cl.[3] ..... B32B 3/02; B32B 33/00

[52] U.S. Cl. ..... 428/95; 428/96; 428/97; 428/921; 428/922

[58] Field of Search ..... 428/95, 921, 922, 96, 428/97

[56] References Cited

U.S. PATENT DOCUMENTS 4,171,395 10/1979 Tillotson ..... 428/95

*Primary Examiner*—Marion McCamish

*Attorney, Agent, or Firm*—Robert F. Delbridge; Arne I. Fors

[57] ABSTRACT

A carpet has an upper carpet layer and a lower backing layer of latex high density foam rubber secured to an undersurface of the carpet layer. The backing layer has a bottom surface substantially covered by a fluorocarbon compound bonded to the backing layer and reducing the tendency of the backing to stick to a floor on which the carpet is laid.

6 Claims, 2 Drawing Figures

NON-STICK LATEX FOAM FLUOROCARBON CARPET BACKING

Figure 1:
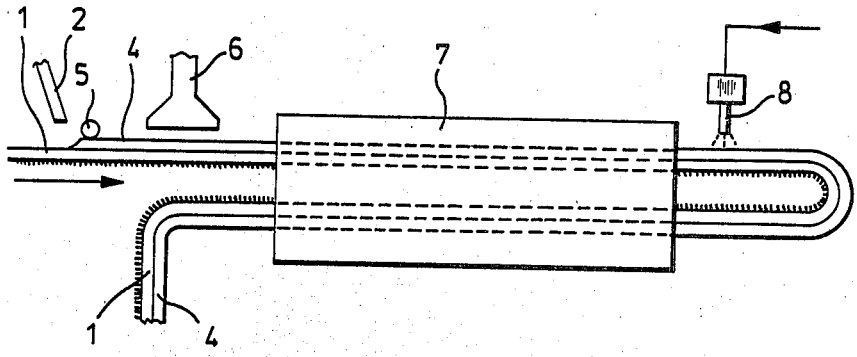

This invention relates to carpets, and more particularly to carpets having an upper carpet layer secured to a resilient lower backing layer of latex high density foam rubber.

Carpet backing layers of high density foam rubber are noted for their satisfactory cushioning effect and relatively long life. However, after a prolonged period of time in place on the floor, such backing layers tend to stick to the floor, whether the floor be of wood, tiles or concrete. It therefore becomes difficult and costly to remove a carpet of this kind which has been in place for a considerable length of time, and removal frequently causes the backing layer to become at least partially detached from the carpet layer, thereby ruining the carpet, as well as damaging the floor in cases where the floor is of tiles or hardwood.

It is therefore an object of the invention to provide an improved carpet of this kind in which the tendency of the latex film to stick to a floor is reduced.

The present invention is based on the discovery that it is possible to bond to the bottom surface of the backing layer a fluorocarbon compound which substantially reduces the tendency of the backing layer to stick to a floor on which the carpet is laid.

Accordingly, the present invention provides a carpet comprising an upper carpet layer and a lower backing layer of latex high density foam rubber secured to an undersurface of the carpet layer, said backing layer having a bottom surface substantially covered by a flourocarbon compound bonded to the backing layer and reducing the tendency of the backing to stick to a floor on which the carpet is laid.

Such a carpet may be produced by applying a fluorocarbon compound to substantially the whole area of a bottom surface of the backing layer, and heating the backing layer and applied fluorocarbon compound to cause the fluorocarbon compound to become bonded to the backing layer such that, after cooling, the fluorocarbon compound reduces the tendency of the backing layer to stick to a floor on which the carpet is laid.

The method may comprise applying the foam rubber as a frothed emulsion to the carpet layer to form an uncured backing layer, partially curing the backing layer by heating the carpet layer and applied emulsion, applying the fluorocarbon compound to the partially cured backing layer with applied fluorocarbon compound to complete the curing of the backing layer and cause the fluorocarbon compound to become bonded thereto.

Alternatively, the method may comprise applying the fluorocarbon compound to a fully cured backing layer secured to a carpet layer and heating the carpet layer and backing layer with applied fluorocarbon compound to cause the fluorocarbon compound to become bonded to the backing layer.

The latex high density foam rubber may for example be carboxylated styrene-butadiene polymer foam, and the fluorocarbon compound may be of the formula

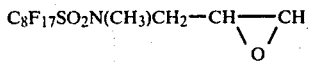

$$C_8F_{17}SO_2N(CH_3)CH_2-\underset{\diagdown\ \diagup \atop O}{CH}-CH$$

or known variations thereof. Preferably, the fluorocarbon compound should contain at least 25% by weight of fluorine.

Figure 2:
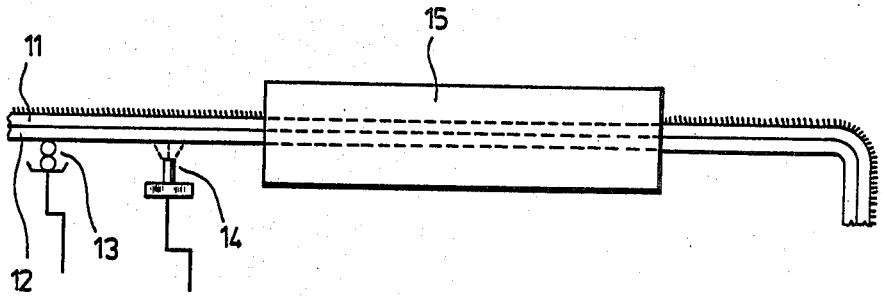

Embodiments of the invention will now be described, by way of example, with reference to the accompanying drawings, of which:

FIG. 1 is a schematic diagram showing the application of the fluorocarbon compound during manufacture of a carpet, and FIG. 2 is a similar view showing application of the fluorocarbon compound to a previously manufactured carpet.

Referring first to FIG. 1 of the drawings, the fluorocarbon compound may be applied to the backing layer during manufacture of the carpet. A length of carpet layer 1 of conventional carpet upper surface material is conveyed in an upsidedown manner along a horizontal path, and a frothed emulsion of carboxylated styrene-butadiene rubber is applied from a nozzle 2 onto the back of the carpet layer 1 and spread into an even layer 4 by a roller 5. The carpet 1 and frothed emulsion therefor then pass under overhead preheater 6 and then through a curing oven 7 which may be gas, steam or oil heated, with the temperature in the oven being about 70° C. or higher. During passage through the oven 7, the frothed emulsion layer 4 becomes semi-cured foam.

After leaving the oven 7, the carpet layer 1 and semi-cured foam backing therefor passes beneath a series of spray heads 8 from which fluorocarbon compound is sprayed as a solution to cover the semo-cured foam backing therefor. The solution may be a 1% to 10% solution of fluorocarbon compound in water. The carpet layer 1 and semi-cured backing therefor with applied fluorocarbon compound then reverses direction and passes through a curing oven 7 to complete curing of the foam rubber backing therefor and dry the fluorocarbon solution. During this stage, the fluorocarbon compound becomes bonded to the surface of the foam rubber backing therefor by attachment of fluorocarbon chains to the rubber by reactive polar groups.

The bottom surface of the cured backing layer 4 of the finished carpet thus has a covering of fluorocarbon compound bonded to the foam rubber backing therefor, such that the tendency of the carpet to stick to a floor is reduced.

FIG. 2 shows a method for applying the fluorocarbon compound to an existing carpet with a carpet layer 11 and a latex high density foam rubber backing layer 12. The carpet is passed along a horizontal path in an upright configuration, and fluorocarbon solution is applied to the bottom surface of the backing layer 12 by a roller applicator 13 or a spray applicator 14. The carpet is then passed to a curing oven 15, similar to the oven 7 of the previous embodiment, at a temperature of about 70° C. or higher for at least four minutes to cause the fluorocarbon compound to become bonded to the foam rubber backing layer 12 and ensure that the treated backing layer 12 is dried.

Other embodiments will be readily apparent to a person skilled in the art, the scope of the invention being defined in the appended claims.

What I claim is:

1. A carpet comprising an upper carpet layer and a lower backing layer of latex high density foam rubber secured to an undersurface of the carpet layer, said backing layer having a bottom surface substantially covered by a fluorocarbon compound bonded to the backing layer and reducing the tendency of the backing to stick to a floor on which the carpet is laid.

2. A carpet according to claim 1 wherein the backing layer is of carboxylated styrene-butadiene polymer foam.

3. A method of reducing the tendency of a carpet to stick to a floor on which it is laid, said carpet having an upper carpet layer and a lower backing layer of latex high density foam rubber secured to an undersurface of the carpet layer, the method comprising applying a fluorocarbon compound to substantially the whole area of a bottom surface of the backing layer, and heating the backing layer and applied fluorocarbon compound to cause the fluorocarbon compound to become bonded to the backing layer such that, after cooling, the fluorocarbon compound reduces the tendency of the backing layer to stick to a floor on which the carpet is laid.

4. A method according to claim 3 comprising applying the foam rubber as a frothed emulsion to the carpet layer to form an uncured backing layer, partially curing the backing layer by heating the carpet layer and applied emulsion, applying the fluorocarbon compound to the partially cured backing layer, and heating the carpet layer and partially cured backing layer with applied fluorocarbon compound to complete the curing of the backing layer and cause the fluorocarbon compound to become bonded thereto.

5. A method according to claim 3 comprising applying the fluorocarbon compound to a fully cured backing layer secured to a carpet layer and heating the carpet layer and backing layer with applied fluorocarbon compound to cause the fluorocarbon compound to become bonded to the backing layer.

6. A method according to claim 3 wherein the backing layer is of carboxylated styrene-butadiene polymer foam.

* * * * *